US007644899B2

(12) United States Patent
Fasanella

(10) Patent No.: US 7,644,899 B2
(45) Date of Patent: Jan. 12, 2010

(54) FORMED SHEET INTERLOCKING BRACKET AND SAW HORSE USING SUCH BRACKET

(76) Inventor: Anthony Fasanella, 58-31 78th St., Middle Village, NY (US) 11379

( * ) Notice: Subject to any disclaimer, the term of this patent is extended or adjusted under 35 U.S.C. 154(b) by 671 days.

(21) Appl. No.: 10/816,684

(22) Filed: Apr. 1, 2004

(65) Prior Publication Data

US 2005/0224291 A1 Oct. 13, 2005

(51) Int. Cl.
*E04G 5/06* (2006.01)
*E04G 5/04* (2006.01)

(52) U.S. Cl. ..... 248/227.4; 248/228.6; 248/229.15; 248/200.1; 248/210; 248/238; 248/218.2; 248/219.1; 248/219.2; 248/219.3; 248/219.4; 248/220.21; 248/220.42; 248/222.14; 248/225.11; 182/224; 182/186.3; 182/186.8

(58) Field of Classification Search ..... 182/153, 182/151, 181.1, 182.4, 186.5, 224–226, 155, 182/186.2, 186.1, 186.3, 186.8, 156, 180.1; 248/188.1, 188.8, 188, 165, 300, 163.1, 440.1, 248/205.1, 200, 313, 218.4, 219.2, 200.1, 248/202.1, 205.4, 205.6, 210, 214, 219.3, 248/220.21, 220.22, 228.6, 229.17, 229.15, 248/220.41, 220.42, 220.43, 222.52, 223.31, 248/224.8, 223.21, 225.11, 229.1, 229.14, 248/229.13, 229.16, 229.2, 229.23, 229.24; 403/187, 188, 189, 286, 291, 232.1, 200; 52/126.1, 127.1, 127.2, 127.3

See application file for complete search history.

(56) References Cited

U.S. PATENT DOCUMENTS

| | | | | | |
|---|---|---|---|---|---|
| 1,429,390 | A * | 9/1922 | Williams | ..... | 5/94 |
| 2,035,436 | A * | 3/1936 | Schafer | ..... | 24/703.1 |
| 2,826,385 | A * | 3/1958 | Osborn | ..... | 248/74.3 |
| 3,078,957 | A * | 2/1963 | Larson | ..... | 182/226 |
| 3,162,916 | A * | 12/1964 | McHugh, Jr. | ..... | 24/198 |
| 3,338,408 | A * | 8/1967 | Evans | ..... | 206/349 |
| 3,443,662 | A * | 5/1969 | Thompson | ..... | 182/155 |

* cited by examiner

*Primary Examiner*—Jeanette Chapman
(74) *Attorney, Agent, or Firm*—Gene Scott; Patent Law & Venture Group

(57) ABSTRACT

A saw horse comprises a pair of frames each assembled from a plurality of wooden struts joined by metal formings of sheet stock. Fabric hinges join the frames at their upper ends. The metal formings are positioned and closed around the beams with piercings engaging the fabric hinges. Spreader struts are also hinged by a fabric strap that permits the spreader struts to lay in horizontal positions when the frames are pulled into an A-shape, and to be oriented in side-by-side vertical positions when the frames are folded together.

5 Claims, 2 Drawing Sheets

FORMED SHEET INTERLOCKING BRACKET AND SAW HORSE USING SUCH BRACKET

RELATED APPLICATIONS

This application claims priority of a Provisional Application having Ser. No. 60/442,599 and filing date of Jan. 27, 2003 and entitled: Folding/collapsing saw horse, bench legs, table legs, etc.

INCORPORATION BY REFERENCE

Applicant(s) hereby incorporate herein by reference, any and all U.S. patents, U.S. patent applications, and other documents and printed matter cited or referred to in this application.

BACKGROUND OF THE INVENTION

1. Field of the Invention

This invention relates generally to brackets for joining the legs of a saw horse or similar apparatus and more particularly to such a bracket formed from sheet metal and providing dual parallel interlocking faces.

2. Description of Related Art

The following art defines the present state of this field:

Rice, U.S. Pat. No. 936,945 describes a device comprising oppositely arranged substantially rectangular plates provided at each end with a flange connected to the plate by a triangular portion, whose apex is upward, whereby to set off and incline the plate with respect to the flanges, said flanges having at each end an ear, the lower ears of the oppositely arranged plates being integral with each other, and said plates, flanges and ears having openings therethrough.

Rebensdorf, U.S. Pat. No. 2,825,606 describes a device for use in assembling, erecting and temporarily coupling horizontal and vertical timbers such as are used, for example, in constructing a knockdown trestle; a bracket comprising a pair of spaced parallel open-ended sleeves adapted for telescoping reception and retention of the end portions of a pair of horizontal beam-forming timbers, means securing said sleeves to each other, and a pair of companion open-ended socket members opposed to each other and affixed at right angles to the outer end portions of their respective sleeves and likewise adapted for telescoping reception and retention of vertical leg-forming timbers.

Tucker, U.S. Pat. No. 2,874,004 describes a portable trestle comprising a pair of legs adapted to support a horizontal member, a bracket at the upper end of each leg and having a head for bearing against the underside of the member, an upper flexible element having connection with the brackets and adapted to overlie the member, and a lower flexible element for connecting the medial portions of the legs for holding the upper element and brackets in engagement with the member when said legs are swung toward each other.

Mitchell, U.S. Pat. No. 3,012,627 describes a ladder iron unit comprising a hollow rectangular body having a rectangular planar rear wall, first and second opposing end walls and a top wall, said first and second end walls and said top wall disposed entirely on one side of said rear wall and: oriented normal thereto, said end walls secured to opposite parallel edges of said rear wall in opposed rotation, said top wall disposed normal to said rear wall and secured along one side to said rear wall and along each of its ends to said end walls; said top wall extending laterally from said rear wall beyond said end walls and terminating in a lip portion extending normal to the remainder of said-top—wall in a direction toward said end walls; one of said end walls formed with a plurality of threaded openings therethrough; a threaded thumb-screw engaged in each of said threaded openings and extending therethrough; and a hinge plate portion joined to said rear wall along the edge of said rear wall corresponding to the location of said top wall and extending on the side of said top wall opposite from said rear wall, said hinge plate disposed with its rear face coplanar with the rear face-of-said rear well, said hinge plats extending laterally beyond each end of said body, said hinge plate formed with two spaced hinge bolt openings therethrough disposed adjacent opposite ends of said hinge plate; said tear wall formed with a plurality of openings therethrough, each of said openings in said rear wait spaced from one of said openings in said hinge plate the same distance as the space between said openings in said hinge plate; one of said, end walls extending downwardly beyond said rear wall and terminating in an outwardly curved bifurcated hook portion, said iron sized and adapted to engage the end of a ladder sidepiece whereby said top wall will extend over the end of said sidepiece and said iron maybe clamped on said sidepiece by tightening said thumb-screws.

Huntington, U.S. Pat. No. 3,691,526 describes a traffic barricade-type structure constructed entirely of polymeric material such as high impact styrene and vinyl and including a pair of spaced A-shaped elongated strip supports with a pair of generally horizontal spaced elongated strips disposed on each side of the A-shaped supports. These supports are hinged at the apex thereof by resilient straps and the spacing between the legs of the supports is limited by transversely disposed resilient straps which may be temporarily uncoupled to allow the supports to be reversed to expose different safety indicia.

Brow, U.S. Pat. No. 5,078,352 describes a foldable sawhorse comprising a two-by-four wooden work member supported in a sheet metal channel near each of its ends. The channels are supported by two tubular leg assemblies pivotally attached to the channels. The pivotal attachments comprise an eye extending from the bottom of each channel and passing through holes in the walls of the legs of the leg assemblies. Each leg assembly comprises two legs and a base; the legs are flattened in cross-section at one of their ends and welded to the base near its ends with the long dimension of the flattened section parallel to the axis of the base. The center portions of the bases are raised a distance equal to about ⅛ the lengths of the bases and are interconnected by a strap which determines the angles between the legs when the sawhorse is unfolded. A lock is provided to prevent inadvertent folding of the leg assemblies toward each other. It comprises a flat rectangular part with two L-shaped slots located such that one leg of each slot is close and parallel to the ends of the part and the other legs extend toward each other and are close and parallel to the bottom edge of the part. The part is attached by collared fasteners to two of the legs near their pivoted connection to a channel such that when the leg assemblies are unfolded the lock part is allowed to move so that the collars of the fasteners are in the slot portions parallel to the ends of the part, preventing the sawhorse from being folded until the lock part is manually lifted to allow the fasteners to move toward each other in the slot portions parallel to the bottom edge of the lock part.

Short, V et al., U.S. Pat. No. 5,950,392 describes a truss element of a structure that is prefabricated, but hinged so that trusses may be reduced in size for transportation and storage. The hinge is made up of a sheet of flexible material, which is affixed to elements of the truss by press fit plates. This press fit hinge can be installed on the truss simultaneously with the other press fit plates used to construct the truss, thereby dramatically reducing the number of steps required to construct the truss while still providing the desired feature of the hinge.

Dirk, II, U.S. Pat. No. 6,142,256 describes a folding sawhorse that is formed from a pair of substantially identical rectangular frames. The frames are constructed from four substantially identical wooden members via lap joints to make a smooth construction. The frames are also pivotally joined together by a pair of hinges fixedly coupled to top portions thereof. A flexible member or chain extends between the frames, but is displaced from the hinges. The hinges allow for pivotal movement of the frames, while the chain limits the range of pivotal movement.

Krajec, U.S. Pat. No. 6,564,903 describes a sawhorse that is constructed with brackets allowing the legs of the sawhorse to fold into a compact unit by having the legs interleave when folded. The legs pivot about a plane that is canted to allow each leg to rotate without interfering with any other leg. The length of the legs is not restricted in any fashion. The legs may also be locked in the extended or service position as well as the closed position. The bracket may be constructed of as few as two unique parts, and a pair may be nested together for compact shipping, storage, and display on a store shelf.

Our prior art search with abstracts described above teaches: a timber coupling and trestle-erecting bracket, a support structure, a socket piece for studding, folding sawhorses, a hinged truss, a collapsible sawhorse bracket with interleaving legs, portable trestles, and a safety device for directing traffic, but does not teach a one piece sheet metal stamped and folded bracket or its use in preparing low cost hinges for a collapsible saw horse. The present invention fulfills these needs and provides further related advantages as described in the following summary.

SUMMARY OF THE INVENTION

The present invention teaches certain benefits in construction and use which give rise to the objectives described below.

A saw horse comprises a pair of frames assembled from a plurality of wooden beams joined by metal formings of sheet stock. Each of the formings having a pair of spaced apart opposing faces joined along a top edge of each of the faces by an integral topper piece. The opposing faces define an interior space. A plurality of piercings extend into the interior space in attitudes directed away from the topper piece. In each of the frames, a horizontal one of the beams is engaged with two of the metal formings in spaced apart positions. Each of the metal formings is engaged with a further one of the beams extending downwardly from the horizontal beam. The metal formings are positioned and closed around the beams with the piercings of at least one of the faces of each of the metal formings impressed into the beams for secure and rigidized attachment.

A primary objective of the present invention is to provide an apparatus and method of use of such apparatus that yields advantages not taught by the prior art.

Another objective is to provide such an invention capable of being used in assembling a saw horse from lengths of lumber.

A further objective is to provide such an invention at a very low cost.

A still further objective is to provide such an invention capable of being assembled without fasteners or tools for fastening.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
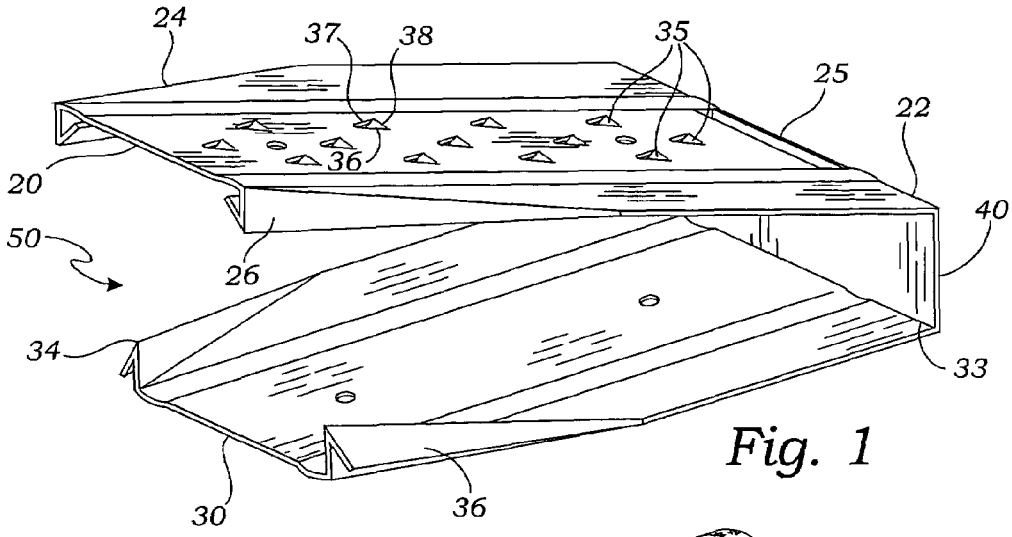
FIG. 1 is a perspective view of a metal forming of the invention.
Figure 2:
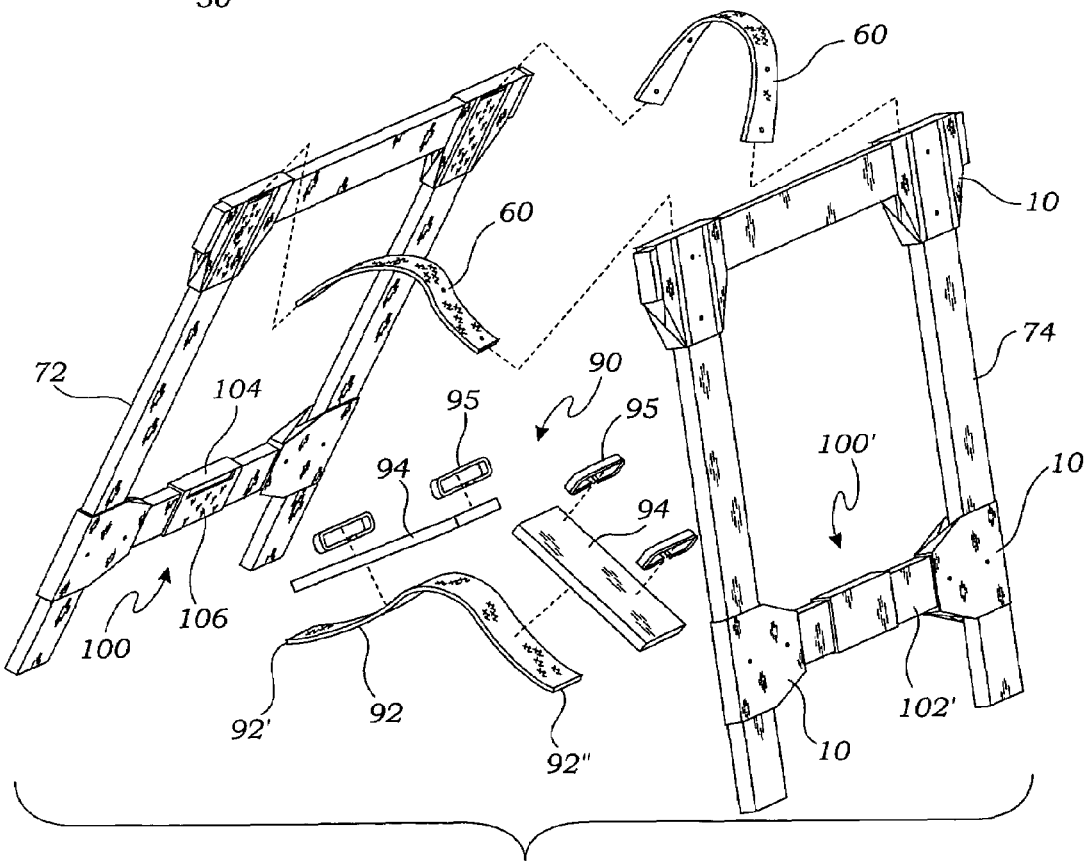
FIG. 2 is an exploded view of a saw horse of the invention in which the forming is used.

The above described drawing figures illustrate the invention in at least one of its preferred embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

The present invention is a metal forming or bracket apparatus used to construct a saw horse. The bracket is a metal forming 10 of sheet stock such as 1/16 to 3/32 inches thick steel sheet. Such a forming 10 is made by stamping, cutting and folding operations that are well known in the sheet metal industry and are easily accomplished by those of skill in this art. The forming 10 has a pair of spaced apart opposing panels 20 and 30 which are joined along a top edge 22, 33 of the faces 20, 30 by an integral topper panel 40. The opposing panels 20, 30 are defined here as sheet metal portions of the forming 10 and by their relative positions, they define an interior space 50 between them. One or both of the panels 20, 30 preferably provides an open slot 25 adjacent to the topper piece 40. A plurality of piercings 35 extend into the interior space 50 in attitudes directed away from the topper piece 40. Such piercings 35 are preferably formed by cutting two sides 36, 37 of a triangle in the faces 20, 30 and then pushing the metal portion within the triangle inwardly into the interior space 50 by bending it along the third leg 38 of the triangle.

The panels 20, 30 each have opposing side edges 24, 26 and 34, 36 respectively. The side edges 24, 26 and 34, 36 are formed as flanges, with at least one of the flanges in one of the opposing panels 20 or 30 formed inwardly and the opposing one of the flanges in the opposing one of the opposing panels is formed outwardly in a manner for locking engagement of the inwardly and outwardly opposing flanges. In FIG. 1 flanges 24 and 26 are directed inwardly, while flanges 34 and 36 are directed outwardly and in such manner as, when the panels 20 and 30 are pressed against each other, the flanges 24 and 34 interlock, and the flanges 26 and 36 also interlock.

Figure 3:
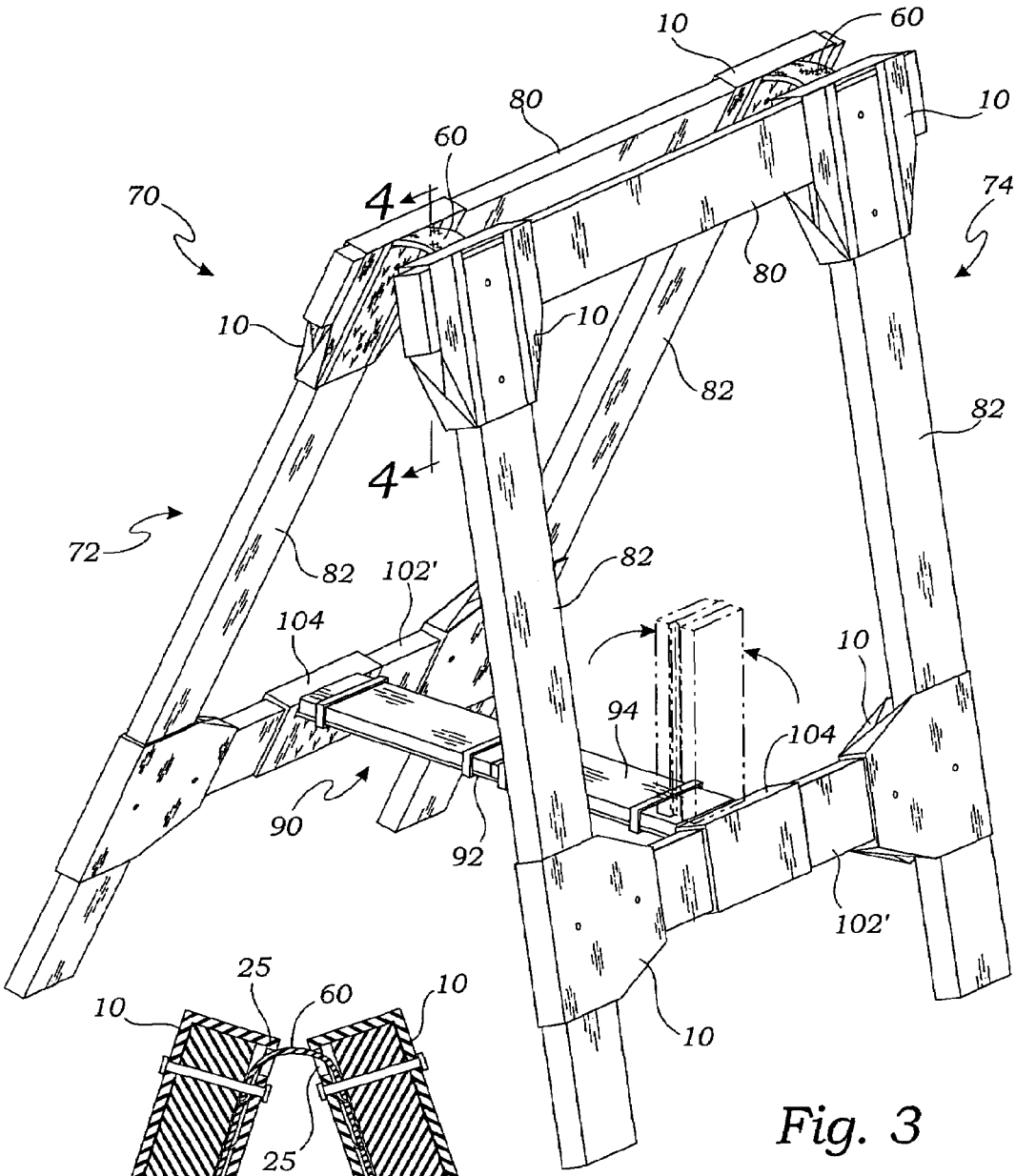
FIG. 3 is a perspective view thereof showing a spreader strut folded in phantom line.
Figure 4:
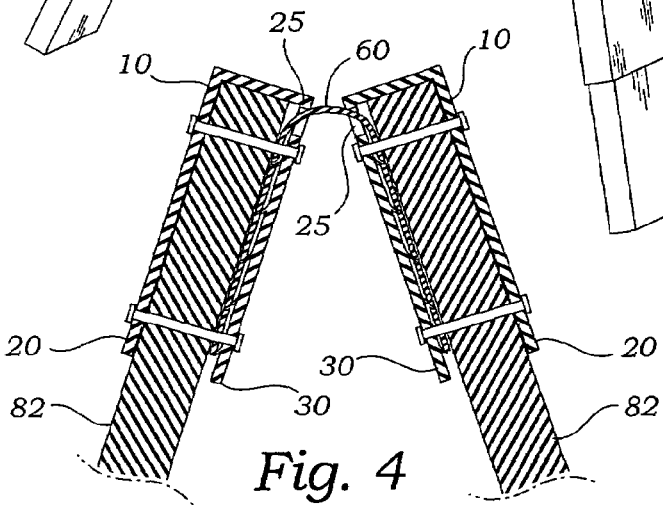
FIG. 4 is a sectional view taken along line 4-4 of FIG. 3.

In assembling saw horse 70, as shown in FIG. 3, flexible straps 60 are engaged through open slots 25 in the opposing panels 20 or 30 in pairs of the formings 10, as is shown in FIG. 4. The flexible straps 60 engage with the piercings 35 of the metal formings 10 so as to be secured within the formings 10.

The saw horse apparatus 70 comprises a pair of frames 72 and 74 as shown in FIG. 3. Each of the frames 72, 74 are assembled from a plurality of wooden beams or lengths of lumber as shown. This lumber is joined by the metal formings 10 so that, in each of the frames 72, 74, a horizontal 80 one of the beams is engaged with two of the metal formings 10 in spaced apart positions. Each of the metal formings 10 is further engaged with a further one of the beams 82 extending downwardly from the horizontal one of the beams 80, the metal formings 10 positioned and closed around the beams 80, 82 with the piercings 35 of at least one of the faces 20, 30 of each of the metal formings 10 impressed into the beams 80, 82 for secure and rigidized attachment thereto. It is noted here that "beam" is used interchangeably with the word "strut."

The saw horse 70 further includes a pair of the flexible straps 60 engaged between the metal formings 10 in the pair of frames 72 and 74 as shown in FIG. 3. The flexible straps 60 are functional as hinges for enabling the pair of frames 72, 74 to be stacked abuttingly for storage and transporting, and alternately, to be set into a mutually leaning, A-shape attitude as shown in FIG. 3.

The apparatus of the present invention further comprises at least one spreader strut or brace 90 engaged between the frames 72 and 74 in a medial position. The brace 90 comprises a further flexible strap 92 engaged with the struts 94 in spaced apart alignment. Connection is by the use of straps 95.

In the preferred mode in the present apparatus, the further strap 92 is terminally engaged at opposing ends 92', 92" with medially positioned horizontal struts 100, 100' in each of the frames 72, 74 respectively. Such a strut 100, 100' is preferably made up and assembled using a lumber length 102 with one of the brackets 10 at either of its ends. Medially positioned on the lumber length 102 is a sleeve 104 with aperture 106 for receiving one end 92' of further strap 92. When it is desired to fold the saw horse 70 so that frames 72 and 74 are abutting, the further strap 92 functions as a hinge to allow brace 90 to fold. When saw horse 70 is in use, brace 90 prevents the frames 72, 74 from moving apart beyond the distance restricted by brace 90.

The words used in this specification to describe the invention and its various embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of this described invention and its various embodiments are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments below or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A bracket apparatus used in assembling a folding saw horse, the apparatus comprising:

a metal forming of sheet stock, the forming having a first and a second spaced apart opposing panels joined along a top edge of each of the opposing panels by an integral topper panel, the opposing panels defining an interior space therebetween;

at least one of the opposing panels providing an open slot adjacent to the topper panel;

a plurality of piercings in at least one of the opposing panels extending into the interior space in attitudes directed away from the topper panel;

each of the opposing panels providing folded edges thereof, the folded edges of one of the opposing panels configured for engaging the folded edged of the other of the opposing panels thereby holding the opposing panels in mutually parallel positions.

2. The apparatus of claim 1 wherein the piercings are triangular in shape.

3. The apparatus of claim 1 wherein at least one of the side edges in one of the opposing panels is formed inwardly and the opposing one of the side edges in the opposing one of the opposing panels is formed outwardly in a manner for locking engagement of the inwardly and outwardly formed opposing side edges.

4. The apparatus of claim 1 further comprising a flexible strap; one end of the strap engaged with the piercings and extending outwardly from the bracket apparatus through the open slot therein.

5. A folding saw horse apparatus comprising:

a pair of saw horse sides, each one of the saw horse sides providing a pair of spaced apart saw horse legs, an upper horizontal strut and a medial horizontal strut the upper saw horse strut engaged at opposing ends thereof with each one of the saw horse legs by one of a pair of metal formings of sheet stock, each of the metal formings having a first and a second spaced apart opposing panels joined along a top edge of each of the opposing panels by an integral tapper panel, the opposing panels defining an interior space therebetween;

at least one of the opposing panels providing an open slot adjacent to the topper panel;

a plurality of piercings in at least one of the opposing panels extending into the interior space in attitudes directed away from the topper panel;

each of the opposing panels providing folded edges thereof, the folded edges of one of the opposing panels configured for engaging the folded edges of the other of the opposing panels thereby holding the opposing panels in mutually parallel positions against the upper horizontal strut and one of the saw home legs;

opposing ends of each of a pair of flexible straps engaged with the piercings of the metal formings and extending outwardly therefrom through the open slots therein thereby functional as a hinge; the medial horizontal strut secured to the saw horse legs on each of the saw horse sides by a further pair of metal formings;

the medial horizontal struts of joined by a pair of rigid spreader struts engaged with a spreader strap, ends of the spreader strap engaged medially with the medially horizontal struts of the opposing saw horse sides;

whereby, with the saw horse sides spread fully apart the spreader struts are aligned horizontally, and with the saw horse sides folded into adjacency, the spreader struts are positioned side-by-side in a vertical orientation.

* * * * *